United States Patent [19]

Laar et al.

[11] 4,245,397

[45] Jan. 20, 1981

[54] APPARATUS FOR DRYING WEBS OF PHOTOGRAPHIC PAPER OR THE LIKE

[75] Inventors: Erwin Laar, Taufkirchen; Friedrich Ganser, Feldkirchen; Thomas Hammer, Munich, all of Fed. Rep. of Germany

[73] Assignee: AGFA-Gevaert, A.G., Leverkusen, Fed. Rep. of Germany

[21] Appl. No.: 925,794

[22] Filed: Jul. 18, 1978

[30] Foreign Application Priority Data

Jul. 29, 1977 [DE] Fed. Rep. of Germany ..... 2734326

[51] Int. Cl.[3] ..... F26B 21/12

[52] U.S. Cl. ..... 34/54; 34/50; 34/155; 34/159; 34/41; 34/68

[58] Field of Search ..... 34/46, 48, 50, 54, 159, 34/155, 225, 4, 41, 68; 354/299, 320, 321

[56] References Cited

U.S. PATENT DOCUMENTS

| | | | |
|---|---|---|---|
| 1,996,020 | 3/1935 | Hurxthal | 34/159 |
| 2,065,070 | 12/1936 | Hanson | 34/159 |
| 2,228,030 | 1/1941 | Hanson | 34/159 |
| 2,456,301 | 12/1948 | Miller et al. | 34/159 |
| 3,470,625 | 10/1969 | Chikamasa et al. | 34/159 |
| 3,533,349 | 10/1970 | Schmidt | 354/321 |
| 3,922,701 | 11/1975 | Geyken et al. | 354/299 |
| 4,139,953 | 2/1979 | Gaskell | 34/159 |

*Primary Examiner*—Larry I. Schwartz
*Attorney, Agent, or Firm*—Peter K. Kontler

[57] ABSTRACT

Apparatus for drying webs of photographic paper has a drying unit which has an inlet for admission of wet webs. Such webs advance along discrete paths having V-shaped portions and are dried by hot air which is circulated by blowers. The temperature of air is maintained at a constant value by a control system which adjusts one or more air heaters in the drying unit. The latter has a portion which is adjacent to and is located at a level below the inlet and wherein the moisture content of air is higher than in other parts of the drying unit. Such moisture content is measured and the signals denoting the measured moisture content are used to control the operation of a device which withdraws moisture-laden air from the aforementioned portion of the drying unit. The withdrawn air is replaced with relatively dry atmospheric air entering the drying unit via outlet opening for the webs.

30 Claims, 2 Drawing Figures

APPARATUS FOR DRYING WEBS OF PHOTOGRAPHIC PAPER OR THE LIKE

BACKGROUND OF THE INVENTION

The present invention relates to apparatus for processing web, bands or strips of photographic films, photographic paper or like photosensitive material. More particularly, the invention relates to improvements in apparatus for wetting and thereupon drying running webs of photosensitive material, especially photographic paper. Such apparatus can be utilized in photographic processing laboratories for customer films wherein webs of exposed photographic paper which carry latent images of customer film frames are transported through a developing machine to contact the webs with developing, fixing and rinsing fluids prior to passage through a drying unit wherein the liquid which is entrained from the last bath is caused to evaporate before the webs are convoluted onto reels or advanced directly to a severing and classifying station.

It is already known to transport webs of wet photographic paper through a drying unit wherein each web advances along a substantially U-shaped path. The drying unit has room for simultaneous transport of several webs along discrete paths, and the width of all webs may but need not be the same. The temperature of air in the drying unit is regulated to remain within a selected range, and the drying unit is further equipped or associated with means for withdrawing spent air from its interior. A blower is employed to circulate the air in the drying unit. The air stream or streams which issue from the outlet of the blower are heated prior to admission laterally into a distributor which is installed at the bight of the U-shaped path. The distributor has orifices which enable heated air to form jets impinging upon the adjacent portions of the running webs. The means for regulating the temperature of air in the drying unit comprises a control device which can turn a heater on or off, depending upon whether the temperature of air drops below the lower limit or rises above the upper limit of the range of acceptable temperatures. The means for withdrawing spent air comprises an exhaust fan below the top wall of the drying unit, and the top wall has an opening for admission of relatively dry atmospheric air. The opening contains an adjustable blind or shutter whose setting determines the quantity of inflowing atmospheric air.

A drawback of the just described conventional apparatus is that it operates satisfactorily only when the quantity of web material in the drying unit matches or approximates a predetermined value. On the other hand, the quantity of web material in the drying unit often fluctuates within an extremely wide range. For example, and assuming that the apparatus defines three discrete paths for webs of maximum width, for webs of medium width and for narrow webs, the quantity of web material is only a minute fraction of the maximum quantity when the apparatus processes a single web, especially a single web of minimum width. Furthermore, the speed at which the web or webs are transported through the drying unit is also likely to fluctuate within a wide range. Moreover, certain webs are likely to attract and entrain relatively large quantities of a liquid processing medium whereas the percentage of liquid which is entrained by a web of a different type is very low.

Since the just described apparatus maintains the temperature of air in the drying unit at a constant value, the drying or moisture-removing action of such air upon a single web is different than upon a set of two or more webs which travel, at the same time, from the inlet to the outlet of the drying unit. By maintaining the temperature of air at a constant value, the just described conventional apparatus cannot undergo adjustments which are necessary when one or more webs of a first type are followed by one or more webs of a different second type or vice versa. An additional drawback of conventional apparatus is that the distribution of heated air upon all surfaces of webs in the drying unit is not uniform; this, too, affects the quality of the drying action. For example, the streams of heated air impinge upon the webs in different directions and often maintain layers of moisture-laden air in long-lasting contact with the webs so that the webs cannot be contacted by air having a lower moisture content. The adjustment of the aforementioned blind is time-consuming and the mounting of the exhaust fan in the interior of the drying unit also presents problems.

OBJECTS AND SUMMARY OF THE INVENTION

An object of the invention is to provide an apparatus which can satisfactorily reduce the quantity of liquid which is carried by one or more webs of identical or different widths, whose energy requirements are low, and which can be readily adjusted for optimum treatment of different types and/or sizes of webs.

Another object of the invention is to provide the apparatus with a novel and improved drying unit which is at least as compact as but more versatile than the drying units of heretofore known apparatus.

A further object of the invention is to provide a simple and relatively inexpensive apparatus wherein the temperature of air in the drying unit can be regulated independently of other characteristics of air and vice versa to thus enable an attendant to carry out all adjustments which are necessary to satisfactorily treat one or more webs of identical or different widths, one or more webs consisting of a wide variety of different materials and/or one or more webs which are transported at a high, medium or low speed.

An additional object of the invention is to provide the apparatus with novel and improved web-conveying, air-distributing and air-withdrawing means.

Another object of the invention is to provide the apparatus with means which admits to the drying unit requisite quantities of relatively dry air and can further perform at least one additional desirable function.

The invention is embodied in an apparatus for treating webs of photosensitive material, particularly for simultaneously treating several webs consisting of photograhic paper and having identical or different widths. The apparatus comprises a wetting unit wherein the webs are contracted with a liquid, an air-filled drying unit, motor-driven rollers or analogous means for conveying the webs along discrete aligned paths each of which includes a first section extending through the wetting unit (e.g., through a body of liquid in the wetting unit) and a second extending through the drying unit so that successive increments of webs leaving the respective first sections entrain some liquid and carry it into the drying unit, means for heating the air in the drying unit which latter includes a portion wherein the moisture content of air is higher than in some or all remaining parts of the drying unit, adjustable means for withdrawing air from the aforementioned portion of the drying unit, means for admitting relatively dry air into the drying unit at a rate which is substantially proportional to the rate of withdrawal of air from the drying unit, means for monitoring the moisture content of air in the aforementioned portion of the drying unit, and means for adjusting the withdrawing means when the monitored moisture content of air in the aforementioned portion of the drying unit deviates from a predetermined value. For example, the withdrawing means can be started or activated when the monitored moisture content is too high and arrested or deactivated when the monitored moisture content reaches the lower limit of a permissible range of moisture contents.

The apparatus preferably further comprises one or more blowers or analogous means for circulating air in the interior of the drying unit.

The aforementioned monitoring means may comprise a moisture detector which serves to transmit first signals denoting the moisture content of air in the aforementioned portion of the drying unit, and the adjusting means includes a source of reference signals denoting the predetermined value of moisture content and means for changing the rate of withdrawal of moist air from the aforementioned portion of the drying unit when the first signals deviate from the reference signals so as to reduce the difference between the monitored moisture content and the predetermined value.

The drying unit preferably comprises a container or vessel having an inlet which establishes communication between the wetting and drying units and through which the webs advance from the first sections into the second sections of the respective paths. The container is further provided with an outlet through which the webs advance on their way from the drying unit. Such outlet may constitute or form part of the aforementioned means for admitting relatively dry air into the drying unit when the withdrawing means is operative to evacuate moisture-laden air from the interior of the container. The container is substantially closed, save for the aforementioned inlet and outlet, and the portion wherein the moisture content of air is relatively high or highest is normally located close to the bottom portion and at a level below the inlet of the container.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary schematic longitudinal vertical sectional view of an apparatus which embodies one form of the invention.

DESCRIPTION OF THE PREFERRED EMBODIMENTS

Figure 2:
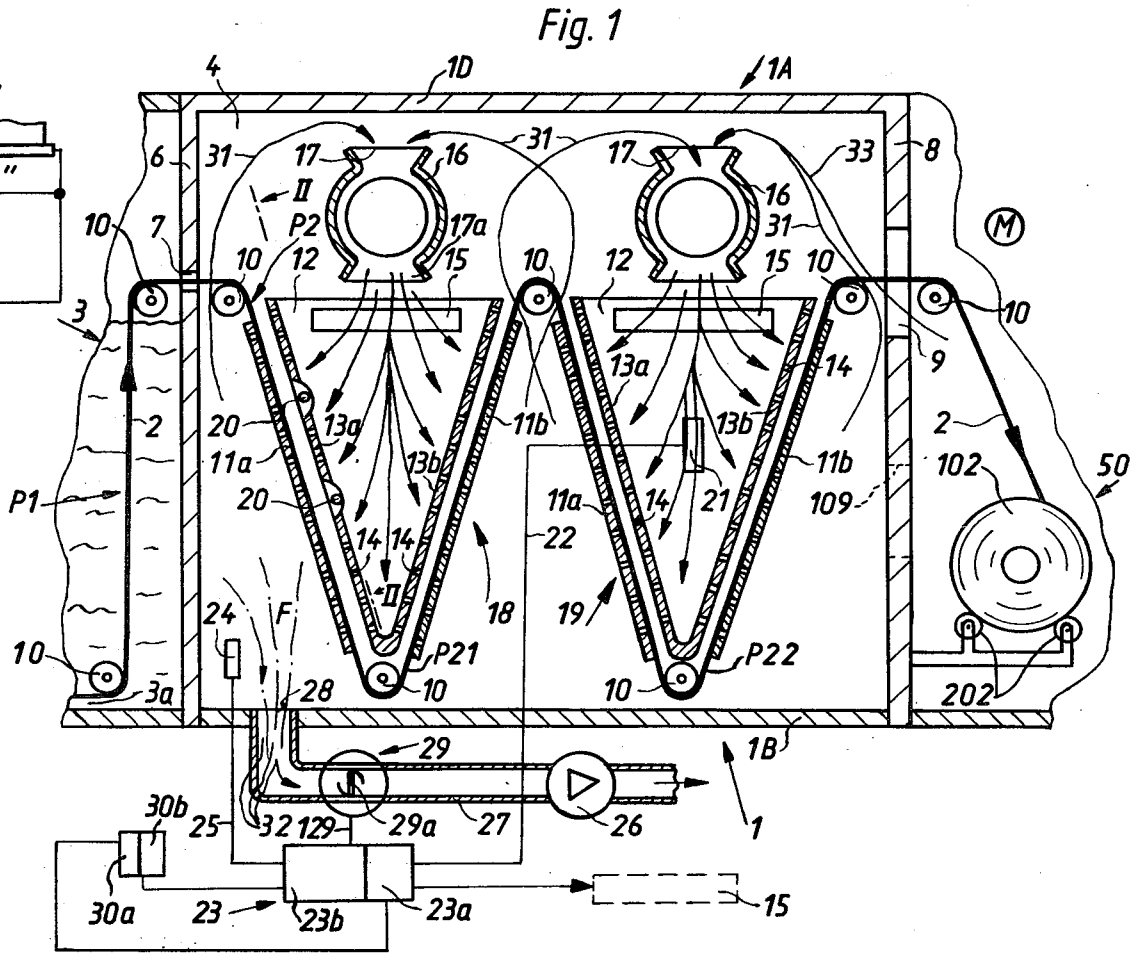
FIG. 2 is a schematic view substantially as seen in the direction of arrows from the line II—II of FIG. 1.

The apparatus of FIG. 1 forms part of a developing machine which is utilized in a photographic processing laboratory to treat webs 2, 2' and 2" (see FIG. 2) of photographic paper or webs consisting of spliced-together photographic customer films. It is assumed that the webs 2—2" consist of photographic paper which carries images of film frames (such images were exposed onto photographic paper during transport through a copying machine prior to introduction of webs into the developing machine). The webs 2, 2', 2" are conveyed through the developing machine along discrete aligned meandering paths to thus prolong the dwell of webs in each of a series of successive processing or treating units. These units include a wetting unit 3 which contains a liquid bath 3*a*, an air-filled drying unit 1 which follows the wetting unit 3, and a web collecting unit 50 having discrete reels 102, one for each of the webs 2, 2' and 2". The reels 102 rest on supporting rolls 202 one of which is driven, for example, in a manner as disclosed in the commonly owned copending application Ser. No. 919,228 filed June 16, 1978, now U.S. Pat. No. 4,181,270 by Erwin Laar et al. to which reference may be had, if necessary. The manner in which the liquid bath 3*a* (or a bath preceding the bath 3a) can receive a regenerator fluid or the like is disclosed in the commonly owned copending application Ser. No. 751,487 filed Dec. 16, 1976, now U.S. Pat. No. 4,134,663 by Erwin Laar et al. The application of Laar et al. (whose disclosure is incorporated herein by reference) further fully discloses and shows discrete aligned paths for several webs of identical or different widths.

The conveying means for the webs 2, 2', 2" comprises roller 10 at least one of which is driven to advance the webs in directions toward the respective reels 102. It is assumed that the roller 10 which is adjacent to the right-hand side of the drying unit 1 is driven by a variable-speed prime mover M.

FIG. 1 shows the path for the web 2 (whose width exceeds the width of the web 2' but is less than the width of the web 2"). This path comprises a meandering first section P1 along which the web 2 moves on its way through the wetting unit 3 and a meandering second section P2 along which the web 2 moves on its way through the drying unit 1. The paths for the webs 2' and 2" are assumed to be identical and aligned with the path for the web 2. Thus, the path for the web 2' registers with and is located behind the path for the web 2, as viewed in FIG. 1, and the path for the web 2" registers with and is located behind the path for the web 2'.

It is assumed that the bath 3*a* in the wetting unit 3 is a rinsing bath, that the unit 3 is preceded by a second wetting unit contaning a fixing bath, and that the second wetting unit is preceded by a third wetting unit containing a supply of liquid developer.

The unit 1 comprises a container 1A having a drying chamber 4 which is substantially sealed from the surrounding atmosphere. The container 1A includes a bottom portion or wall 1B, a top portion or wall 1D, a left hand side wall 6 which constitutes a partition between the units 1 and 3, a right-hand side wall 8 which constitutes a partition between the units 1 and 50, a front wall (not shown) and a rear wall 1E. The collecting unit 50 need not be confined in a container, chamber or the like.

The side wall or partition 6 of the container 1A has a relatively narrow slit-shaped inlet opening 7 which is located at a level above the liquid bath 3a and through which the webs 2, 2' and 2" advance from the first to the second sections of their respective paths. The side wall or partition 8 has a relatively wide outlet opening 9 though which successive increments of the webs 2, 2', 2" advance on their way from the drying unit 1 toward the respective reels 102. As will be explained below, the outlet opening or outlet 7 can perform an additional important function, namely, to admit requisite quantities of relatively dry atmospheric air into the chamber 4 of the container 1A.

The conveying roller 10 in the chamber 4 cause each of the webs 2, 2', 2'' to travel along two successive V-shaped portions of the second sections of their respective paths. FIG. 1 shows the V-shaped portions P21 and P22 of the path section P2 for the web 2. Such configuration of second path sections insures that the webs 2, 2', 2'' cover substantial distances on their way from the inlet opening 7 to the outlet opening 9, and also that the trailing portions of the webs can be dried in the same way as the major part of each web.

The chamber 4 contains two modules 18 and 19 which can be integrally connected with each other to form a single module. Such module or modules can be said to constitute a component of the drying unit 1. The modules 18, 19 are disposed one behind the other, as considered in the direction of travel of webs 2, 2' and 2'' from the inlet opening 7 toward the outlet opening 9. The module 18 comprises a hollow V-shaped (wedge-like) insert 12 which extends into the V-shaped portion P21 of the path section P2 (and of the other two second path sections) and includes two mutually inclined air-permeable walls **13*a*, 13*b* having openings or ports 14 which can direct jets of air against the adjacent portions of the webs 2—2''. The insert 12 has an open top and contains an adjustable heater 15 disposed below a downwardly directed outlet 17*a* of an air circulating blower 16 located at a level above the path portion P21. An inlet 17 of the blower 16 faces upwardly; however, such inlet can also face in a direction to the right or to the left, as viewed in FIG. 1, as long as it faces in a direction other than toward the path portion P21. The (predetermined) distance between the inlet 17 and the top wall 1D of the container 1A is preferably selected with a view to insure that the blower 16 can draw a requisite quantity of air from the chamber 4 when the prime mover for the blower 16** is operative.

The module 18 further comprises two air-permeable elements (hereinafter called screens) **11*a*, 11*b* which are adjacent and parallel to but spaced from the corresponding walls 13*a*, 13*b* of the insert 12. The V-shaped path portion P21 extends between the screens 11*a*, 11*b* and the walls 13*a*, 13*b*. As shown in FIG. 1, the roller 10 below the insert 12 of the module 18 can be installed in such a way that the outer side of the web 2 in the path portion P21 is supported by and slides along the inner sides of the screens 11a, 11b**.

The construction of the second module 19 is preferably identical with that of the module 18. The hollow insert 12 of the module 19 accommodates a temperature monitoring device or detector 21 which transmits signals to the corresponding input of an adjusting or control unit 23 for the heaters 15 of the modules 18 and 19 (or at least for the heater of the module 18 or 19). The monitoring device 21 (e.g., a transducer which transmits electric signals denoting the temperature of air below the heater 15 of the module 19) is located substantially centrally in the interior of the respective insert 12. The conductor means which connects the output of the monitoring device 21 with the adjusting unit 23 is shown at 22.

The chamber 4 further contains auxiliary heating means which is adjacent to the first V-shaped path portions (including P21) and comprises several discrete infrared heaters 20, 20', 20, preferably at least one for each of the webs 2—2''. In the illustrated embodiment, the auxiliary heating means comprises a group of two heaters 20, 20', 20 for each web 2, 2', 2, and the heaters 20, 20', 20 of each group are disposed one behind the other, as considered in the direction of travel of the respective web 2, 2', 2 toward the outlet opening 9. As shown in FIG. 1, the auxiliary infrared heaters 20 for the web 2 are installed in the wall 13a of the left-hand insert 12 to heat successive increments of the web 2 at the inner side of the adjacent screen **11*a*. One of the auxiliary heaters for the web 2' is shown in FIG. 2 at 20', and FIG. 2 further shows one of the auxiliary heaters 20'' for the web 2''**.

FIG. 2 also shows an energy source 120 for the auxiliary heaters 20, 20', 20'' and conductors with switches 220 which connect these heaters 20, 20', 20 with the energy source 120 in such a way that each auxiliary heater can be turned on or off independently of each other auxiliary heater. The apparatus preferably comprises automatic actuating means (not shown) for the switches 220 so as to activate or deactivate the corresponding auxiliary heaters 20, 20' or 20'' in automatic response to detection of the presence or absence of webs 2, 2' or 2 in the respective paths. Furthermore, one of the auxiliary heaters 20 can be activated or deactivated independently of the other heater 20; the same preferably applies for the groups of auxiliary heaters including the components 20' and 20''. The heaters 20—20'' are elongated and preferably extend transversely of the direction of travel of webs 2—2'' toward the outlet opening 9. The auxiliary heaters 20—20'' will be activated or deactivated in dependence on the presence or absence of webs in the respective paths and/or in dependence on the nature of the material of the webs. Thus, certain types of photographic paper can be adequately dried during travel through the chamber 4 while the corresponding auxiliary heaters 20, 20', or 20 are inactive.

It will be readily appreciated that the moisture content of air in the chamber 4 is not uniform. This is due to several factors, such as the provision of a relatively large outlet opening 9 which allows relatively dry atmospheric air to enter the container 1A downstream of the module 19, the fact that each increment of a web 2, 2', or 2'' which enters the container 1A via the inlet opening 7 carries a relatively large quantity of liquid, the provision of auxiliary heaters 20–20'' in a predetermined portion of the chamber, the fact that portions of the webs 2, 2' or 2'' are confined between the inserts 12 and the corresponding screens **11*a*, 11*b*, the fact that the heaters 15 are installed in the hollow inserts 12, and/or certain other factors. It has been determined, on the basis of extensive experimentation, that a portion (F) of the drying unit 1 wherein the moisture content of air is higher than in other portion or portions of the unit 1 is adjacent to the bottom portion 1B of the container 1A and is relatively close to the side wall or partition 6. This may be attributable to the fact that the portion F is close to the inlet opening 7, that the portion F is close to the auxiliary heating means 20–20'', that moisture-laden air tends to descend into the bottom zone of the chamber 4, that moisture-laden air is blown toward the bottom portion 1B in the spaces between the paths for the webs 2–2''** and/or to a combination of such factors.

In accordance with a feature of the invention, the portion F of the drying unit 1 contains a moisture monitoring device 24 (e.g., a capacitive moisture detector of the type often utilized in the tobacco- and alfalfa-processing industries) which transmits electric signals to the adjusting unit 23 via conductor means 25. Such signals are indicative of the monitored moisture content of air in the portion F and are utilized for adjustment of a valve 29 forming part of means for withdrawing moisture-laden (spent) air from the portion F of the drying unit 1. The withdrawing means further comprises a pump 26 whose intake is connected with a conduit 27 containing the valve 29. The inlet 28 of the conduit 27 communicates with the portion F. The valve 29 may comprise a pivotable flap 29*a* which acts not unlike an adjustable restrictor of air flow from the inlet 28 toward the pump 26. The means for changing the position of the flap 29*a* may comprise a servomotor (denoted by the line 129) which is controlled by the adjusting means 23.

The apparatus further comprises two adjustable sources 30*a*, 30*b* of reference signals. Each such source may comprise or constitute an adjustable potentiometer. The sources 30*a*, 30*b* are respectively connected with the corresponding portions 23*a*, 23*b* of the adjusting means 23. The portion 23*a* compares the reference signal from 30*a* (such reference signal denotes the desired or selected temperature of air in the region of the detector 21) with the signal which is transmitted by the detector 21 and adjusts one or both heaters 15 when the monitored temperature deviates from the selected (predetermined) temperature. Analogously, the portion 23*b* compares the reference signal from 30*b* (such signal denotes the selected or predetermined value of moisture content) with the signal which is transmitted by the detector 24 and adjusts the servomotor 129 to respectively increase and reduce the rate of evacuation of moisture-laden air via pipe 27 when the monitored moisture content respectively exceeds and is less than the desired moisture content. The outlet opening 9 admits relatively dry atmospheric air at the rate at which the valve 29 allows the pump 26 to withdraw moisture-laden air. It is clear that the outlet opening 9 need not constitute or form part of means for admitting relatively dry air into the chamber 4. For example, the size of the opening 9 can be reduced and a second opening 109 (shown by broken lines) can be provided in the partition 8 or in another portion of the container 1A.

The control unit 23 cooperates with the heaters 15, opening 9 and/or 109, and air withdrawing means 26-29 so as to climatize or condition the chamber 4 in dependency on the quantity of web material in the drying unit 1, in dependency on the nature or type of photographic paper, and/or by consideration of one or more additional parameters.

The operation is as follows:

The conveying means including the rollers 10 advances the webs 2-2″ along the respective paths whereby each web entrains at least one film or liquid during travel from the bath 3*a* into the chamber 4. The sources 30*a*, 30*b* of reference signals are adjusted so as to insure that the temperature and moisture content of air in the drying unit 1 are best suited for treatment of the webs 2-2″, i.e., that such parameters are selected in dependency on the type of processed photographic paper.

The inlets 17 of the blowers 16 draw air in the directions indicated by arrows 31 and the outlets 17*a* direct streams of air against the respective heaters 15. Heated air penetrates through the openings or ports 14 in the walls 13*a*, 13*b* of the insert 12 to impinge upon the webs in the respective portions (see P21 and P22) of the second sections Pa of the corresponding paths. The pressure in each opening 14 of each insert 12 closely approximates or matches a given pressure owing to the fact the side walls 13*a*, 13*b* of each wedge-like insert 12 converge in a direction toward the bottom portion 1B of the container 1A, i.e., away from the respective outlets 17*a*.

The detector 21 monitors the temperature of air below the heater 15 of the second module 19 and transmits signals which are compared with the reference signal from 33*a* to enable the portion 23*a* to adjust one or both heaters 15. The arrangement may be such that the heaters 15 are adjusted continuously or are simply turned on or off.

The detector 24 monitors the moisture content of air in the portion F and transmits signals which are compared with the reference signal from the source 30*b*. This enables the portion 23*b* of the adjusting unit 23 to change the position of the valve 29 via servomotor 129. Again, the valve 29 can be adjusted between a large number of positions or is simply opened or closed. In the latter instance, the servomotor 129 may constitute a solenoid. The motor (not shown) for the pump 26 is preferably in operation at all times, i.e., whenever the developing machine including the apparatus of FIGS. 1 and 2 is in actual use. The withdrawing means 26–29 cooperates with the air-admitting means 9 and/or 109 to insure that the moisture content of air in the portion F matches that value which is selected by the setting of the source 30*b*.

The arrows 31 indicate the circulation of air in the chamber 4 when the valve 29 is closed. When the adjusting unit 23 causes the valve 29 to open, the conduit 27 allows moisture-laden air to leave the chamber 4 by flowing in the directions indicated by arrows 32. Fresh air flows into the container 1A in directions indicated by the arrow 33. The inflow of air via opening 9 (and/or 109) is due to the fact that the pressure of air in the portion F drops as soon as the valve 29 opens.

An important advantage of the improved apparatus is that the energy requirements of the heaters 15 are low. Thus, and especially if the heaters 15 are simply turned on or off, they are operative only at such intervals as are necessary to insure that the temperature of air in the chamber 4 does not decrease below a minimum permissible value. Low energy requirements of the heaters 15 are further attributable to the fact that the opening 9 and/or 109 admits relatively cool atmospheric air only when the moisture content of air in the portion F rises beyond the value which is selected by setting of the source 30*b*. The placing of the detector 24 into the portion F wherein the moisture content of air is high or highest insures that hot moisture-laden air is evacuated only in such quantities as are needed to avoid saturation or excessive moisturization of circulating air. If the valve 29 is designed to merely open or close, the blowers 16 simply circulate hot air in the chamber 4 while the heaters 15 are turned off, as long as the detector 21 and/or 24 does not transmit a signal which indicates that the temperature of air is too low and/or that the moisture content of air in the portion F is too high.

A further important advantage of the apparatus is that the trailing ends of the webs are conditioned just as satisfactorily as the leaders and/or median portions of the webs. This is attributable to the provision of conveying means which define substantially V-shaped path portions (see P21 and P22) for the webs in the chamber 4. The trailing portion of the web 2 slides along the screens 11*a*, 11*b* of FIG. 1 and is subjected to the same conditioning action as the preceding portion or portions of the web. In conventional apparatus wherein the webs travel along U-shaped paths, the trailing portions of the webs do not remain in their paths so that the conditioning of such trailing portions is unpredictable. As a rule, the trailing portions leave the rollers at the upper ends of U-shaped paths and are likely to move sideways so as to enter the paths for the threading strips (such threading strips are shown and described in the aforementioned copending application Ser. No. 751,487 of Laar et al now U.S. Pat. No. 4,134,663.). The threading strips are likely to damage the webs.

An additional advantage of the apparatus is that the blowers 16 are readily accessible for the purposes of inspection, maintenance or repair. All that is necessary is to remove a portion of or the entire top wall 1D. As mentioned above, conventional apparatus employ blowers which are laterally adjacent to the paths for the webs.

The provision of composite auxiliary heating means with several discrete auxiliary heaters and separate activating means for each auxiliary heater also contributes to low operating cost of the apparatus. Thus, one or more auxiliary heaters will be turned on only when the nature of photographic paper is such that additional heating of paper is necessary in order to insure that the moisture content of material which is convoluted onto the reels 102 is satisfactory for further processing.

Another advantage of the apparatus is that at least some portions of webs in the chamber 4 are heated and dried by circulating air which flows counter to the direction of advancement of webs toward the collecting unit 50. For example, a certain amount of air which penetrates through the openings 14 of the walls 13*a* will flow upwardly, i.e., counter to the direction of travel of the web 2 from the roller 10 which is adjacent to the inlet opening 7 or from the roller 10 between the outlets 17*a* of the blowers 16 toward the roller 10 at the lower end of the respective insert 12. The air streams which are drawn into the chamber 4 via opening 9 also flow counter to the direction of transport of the webs toward the respective reels 102. Still further, a certain amount of air which passes through the openings 14 of the walls 13*b* will flow downwardly toward the lower end portions of the corresponding inserts 12. Such countercurrent flow of air is desirable because it contributes to rapid and uniform drying action.

The apparatus of the present invention insures that the condition of air in the chamber 4 is not affected (or does not change from a desired condition) as a result of changes of the quantity of paper which is transported through the container 1A per unit of time. Therefore, the drying action is uniform regardless of the number and/or width of webs which advance from the inlet opening 7 toward the outlet opening 9, i.e., regardless of the quantity of liquid which enters the chamber 4 via inlet 7 per unit of time. It has been found that the energy requirements of the apparatus do not increase to a large extent when the quantity of photographic paper in the chamber 4 increases, i.e., the operation of the apparatus is economical. Furthermore, the apparatus takes advantage of the fact that some cooler and relatively dry atmospheric air enters the chamber 4 when the pump 26 is free to draw moisture-laden air from the drying unit 1. Thus, the low moisture content of air which enters the chamber 4 when the valve 29 is open is desirable in order to insure that the valve 29 can be closed after a relatively short interval of time because the air which is evacuated via conduit 27 is replaced with air whose moisture content is low. The aforementioned blinds or shutters which constitute important elements of conventional apparatus can be omitted, i.e., the effective cross-sectional area of the opening 9 and/or 109 need not be regulated at all.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for treating webs of photosensitive material, particularly for simultaneously treating several webs consisting of photographic paper and having identical or different widths, comprising a wetting unit wherein the webs are contacted with a liquid; and air-filled drying unit including a substantially closed container having a bottom portion; means for conveying the webs along discrete paths each including a first section extending through said wetting unit and a second section extending through said drying unit whereby successive increments of webs leaving the respective first sections entrain some liquid and carry the same into said drying unit; means for heating the air in said drying unit; adjustable means communicating with and operative for withdrawing air from said bottom portion in which the moisture content of air is higher than in other parts of said drying unit; means for admitting relatively dry air into said drying unit at a location which is remote from said bottom portion at a rate which is substantially proportional to the rate of withdrawal of air from said drying unit; means for monitoring sensing the moisture content of air in said bottom portion of said drying unit; and means for adjusting said withdrawing means when the monitored sensed moisture content of air deviates from a predetermined value.

2. Apparatus as defined in claim 1, further comprising means for circulating air in said drying unit.

3. Apparatus as defined in claim 1, wherein said sensing means includes a moisture detector arranged to transmit first signals denoting the moisture content of air in said portion of said drying unit, said adjusting means including a source of reference signals denoting said predetermined value of moisture content and means for changing the rate of withdrawal of moist air from said portion of said drying unit when said first signals deviate from said reference signals so as to reduce the difference between the sensed moisture content and said predetermined value.

4. Apparatus as defined in claim 1, wherein said drying unit comprises a container having an inlet which establishes communication between said units and through which the webs advance from said first sections into the respective second sections of the corresponding paths, and an outlet through which the webs advance to leave said drying unit.

5. Apparatus as defined in claim 1, wherein said withdrawing means comprises a pump, conduit means connecting the intake of said pump with said drying unit in the region of said portion wherein the moisture content of air is higher, and adjustable valve means in said conduit means.

6. Apparatus as defined in claim 5, wherein said adjusting means includes means for adjusting said valve means in dependency on deviations of the sensed moisture content from said predetermined value so as to respectively increase and reduce the rate of flow of air in said conduit means when the deviation of sensed moisture content from said predetermined value respectively increases and decreases.

7. Apparatus as defined in claim 1, wherein said heating means is adjustable, and further comprising means for sensing the temperature of air in said drying unit and means for adjusting said heating means when the sensed temperature deviates from a predetermined temperature.

8. Apparatus as defined in claim 7, further comprising means for selecting said predetermined value of the moisture content of air in said portion of said drying unit and means for selecting said predetermined temperature independently of the selection of said predetermined value.

9. Apparatus as defined in claim 8, wherein said selecting means are operable to respectively select said predetermined value and said predetermined temperature in dependency on the nature of webs which are conveyed along said paths.

10. Apparatus as defined in claim 1, wherein said second section of each of said paths includes at least one substantially V-shaped portion and further comprising means for circulating air in said drying unit, said circulating means including at least one blower disposed in said drying unit at a level above said V-shaped portions of said second sections.

11. Apparatus as defined in claim 10, wherein said drying unit comprises at least one substantially V-shaped hollow foraminous insert adjacent said V-shaped portions of said second sections, said blower having an air-discharging outlet arranged to discharge air into the interior of said insert.

12. Apparatus as defined in claim 11, wherein said insert comprises air-permeable walls adjacent to said V-shaped portions of said second sections.

13. Apparatus as defined in claim 11, wherein said drying unit further comprises air-permeable screens adjacent to but spaced from said air-permeable walls, said V-shaped portions of said second sections of said paths extending between said screens and said walls.

14. Apparatus as defined in claim 1, wherein said drying unit has a relatively narrow inlet which establishes communication between said units and through which the webs advance from said first sections into said second sections of their paths, and a relatively wide outlet through which the webs advance on their way out of said drying unit.

15. Apparatus as defined in claim 14, wherein said outlet constitutes or forms part of said air admitting means.

16. Apparatus as defined in claim 1, further comprising means for circulating air in said drying unit, including at least one blower disposed at a level above said second sections of said paths and having an inlet for air, said inlet facing in a direction other than toward said second sections of said paths.

17. Apparatus as defined in claim 16, wherein said blower has an outlet arranged to discharge at least one stream of air for flow in a direction at least in part counter to the direction in which the webs are conveyed along said second sections of said paths.

18. Apparatus as defined in claim 1, wherein said second sections of said paths include several substantially V-shaped portions disposed one behind the other, as considered in the direction of movement of webs through said drying unit, said drying unit further comprising a plurality of substantially V-shaped hollow foraminous inserts adjacent said V-shaped portions, and further comprising means for circulating air in said drying unit including a discrete blower for each of said inserts and each arranged to discharge air into the respective insert.

19. Apparatus as defined in claim 18, wherein said heating means includes discrete heaters arranged to heat air which issues from said blowers and flows into the respective inserts.

20. Apparatus as defined in claim 18, wherein said inserts include air-permeable walls adjacent to the respective V-shaped portions of said second sections and further comprising air-permeable screens adjacent to but spaced from said walls, said V-shaped portions of said second sections extending between said walls and said screens.

21. Apparatus as defined in claim 20, wherein said inserts and said screens constitute at least one prefabricated module.

22. Apparatus as defined in claim 21, wherein said blowers have outlets arranged to discharge air streams flowing at least in part counter to the direction of movement of webs along said second sections of said paths.

23. Apparatus as defined in claim 1, further comprising auxiliary heating means for webs in said second sections of said paths.

24. Apparatus as defined in claim 23, wherein said auxiliary heating means includes infrared heaters.

25. Apparatus as defined in claim 23, wherein said drying unit has an inlet which establishes communication between said units and through which the webs advance from said first into said second sections of the respective paths, said auxiliary heating means being adjacent to said inlet.

26. Apparatus as defined in claim 25, wherein said auxiliary heating means includes at least one discrete elongated heater for each of said paths, said heaters extending substantially transversely of the direction of movement of webs along said second sections of said paths.

27. Apparatus as defined in claim 26, further comprising means for actuating and deactivating said discrete heaters independently of each other.

28. Apparatus as defined in claim 23, wherein said auxiliary heating means includes a group of discrete heaters for each of said second sections, the heaters of each group being disposed one behind the other, as considered in the direction of movement of webs along the respective second sections.

29. Apparatus as defined in claim 28, further comprising means for activating and deactivating the heaters in each of said groups independently of each other heater in the respective group.

30. Apparatus for treating webs of photosensitive material, particularly for simultaneously treating several webs consisting of photographic paper and having identical or different widths, comprising a wetting unit wherein the webs are contacted with liquid; an air-filled drying unit; means for conveying the webs along discrete paths, each including a first section extending through said wetting unit and a second section extending through said drying unit whereby successive increments of the webs leaving the respective first sections entrain some liquid and carry the same into said drying unit; means for heating the air in said drying unit; means for inducing air flow through said drying unit toward said second sections, where the flowing air accepts moisture from the webs being dried, and then beyond the same into a downstream portion of said drying unit in which the moisture contents of air is higher than in other parts of said drying unit, including adjustable withdrawing means communicating with said downstream portion of said drying unit and withdrawing air therefrom, and admitting means for admitting relatively dry air into said drying unit at a location which is remote from said downstream portion and at a rate which is substantially proportionate to the rate of withdrawal of air from said downstream portion of said drying unit; means for sensing the moisture content of air in said downstream portion of said drying unit; and means for adjusting said withdrawing means when the sensed moisture content of air in said downstream portion deviates from a predetermined value.

* * * * *